US005131198A

United States Patent [19]

Ritchie et al.

[11] Patent Number: 5,131,198

[45] Date of Patent: Jul. 21, 1992

[54] CORNER BEAD FOR DRYWALL CONSTRUCTION

[75] Inventors: James A. Ritchie, Delta, Canada; Don E. King, Redmond, Wash.

[73] Assignee: BeadeX Manufacturing Company, Inc., Renton, Wash.

[21] Appl. No.: 750,047

[22] Filed: Aug. 27, 1991

Related U.S. Application Data

[63] Continuation-in-part of Ser. No. 541,894, Jun. 21, 1990, abandoned.

[51] Int. Cl.[5] ..... E04B 2/00; E04F 13/06

[52] U.S. Cl. ..... 52/287; 52/288; 52/417

[58] Field of Search ..... 52/415, 416, 417, 287, 52/288, 254, 716, 631

[56] References Cited

U.S. PATENT DOCUMENTS

| | | | |
|---|---|---|---|
| 2,234,701 | 3/1941 | Lyman | 52/417 |
| 3,090,087 | 5/1963 | Miller | 52/417 |
| 3,109,207 | 11/1963 | Cooper | 52/287 X |
| 4,863,774 | 9/1989 | Tucker | 52/417 X |
| 4,876,837 | 10/1989 | Kelly et al. | 52/254 X |
| 4,977,718 | 12/1990 | Hoffman, Sr. | 52/416 X |
| 5,037,686 | 8/1991 | Conboy | 52/417 X |
| 5,048,247 | 9/1991 | Weldy | 52/417 X |

FOREIGN PATENT DOCUMENTS

| | | | |
|---|---|---|---|
| 0153625 | 5/1952 | Australia | 52/254 |

*Primary Examiner*—David A. Scherbel
*Assistant Examiner*—Robert Canfield
*Attorney, Agent, or Firm*—Seed and Berry

[57] ABSTRACT

A corner bead for drywall construction has a galvanized steel core strip which is formed with a central portion, side flanges, and shoulders joining the central portion and side flanges. The front face of the core strip is covered with a paper layer having an outer protective coating thereon overlying the central portion adjoining said shoulders. A paper reinforcing layer covers the back of the core strip in one embodiment to minimize the thickness of the core strip.

7 Claims, 2 Drawing Sheets

CORNER BEAD FOR DRYWALL CONSTRUCTION

DESCRIPTION

This application is a continuation-in-part of copending application Ser. No. 07/541,894, filed Jun. 21, 1990.

TECHNICAL FIELD

The present invention relates to corner beads for drywall construction, and particularly to those having an outer paper layer.

BACKGROUND OF THE INVENTION

In the corner bead for drywall construction art two types of beads have been commonly used, the "nail-on" type and the "tape-on" type. Nail-on beads commonly take the form of an angle strip of metal with side flanges meeting at a center corner rib providing shoulders against which spackle or joint cement can be dressed when feathered from the adjoining wall surfaces to cover the edges and outer faces of the side flanges and the heads of the nails securing these flanges to the wall structure. These nails are usually driven through the bead flanges at intervals of no more than eight inches.

Another form of nail-on bead has a rounded nose section between side flanges and presents step-down shoulders at the junctures of the rounded nose and the side flanges. The nails are driven through the side flanges and the spackle or joint cement covering the flanges is dressed to the shoulders, leaving the rounded nose section exposed to be painted later. For purposes of later discussion, corner beads with an abrupt corner will be referred to as the "hard-line" type, and the corner beads with a rounded nose will be referred to as the "soft-line" type.

Tape-on corner beads utilize paper wings to secure a metal corner angle in position rather than using nails. These wings are lateral extensions of a paper cover strip which is bonded by a hot melt glue or other suitable adhesive to the metal corner angle, usually on the outer faces of the side flanges. The metal corner angle can be shaped as the hard-line type or soft-line type. Spackle or joint cement and wall paint for dressing and finishing the corner, normally adhere significantly better to the paper cover strip of tape-on beads than to the exposed metal of nail-on beads. Also, normally drywall corners covered with nail-on heads are more susceptible to developing crack lines along the outer edges of the side flanges than when tape-on beads are used. On the other hand, nail-on beads have the advantage of requiring less skill to apply.

Preparatory to painting the wall board adjoining a corner covered by a corner bead, the spackle or joint cement spread from the wall surface onto the corner bead is sanded to provide a smooth continuous surface from the wall board to the corner bead. In the case of tape-on beads the exposed portion of the outer paper layer is commonly scuffed during the sanding operation, thereby making it more difficult to later obtain a smooth painted surface at the corner. This scuffing is usually most pronounced at the corner rib of a hard-lien bead, and at the two shoulders adjoining the rounded nose of a soft-line bead.

SUMMARY OF THE INVENTION

The present invention provides an improved nail-on corner bead having advantages of tape-on beads and which can be produced economically. The invention also provides a solution to the scuffing problem of tape-on beads.

In accordance with the present invention, a metal corner element (hard-line or soft-line) is covered on the outside with a paper layer which is folded around the outer edges of the corner element and is bonded to the corner element. The back side of the metal corner element is preferably provided with a reinforcing layer of paper between the folded-around portions of the front paper layer. This permits the metal corner element to be of thinner material. The overall cost of the thinner metal and reinforcing backing paper provides a structure currently more economical to produce than when metal alone is used of a thickness normally currently found (0.012–0.013 inches) on all-metal nail-on corner beads. The corner element has a pair of shoulders as currently provided on hard-line and soft-line types, respectively, of nail-on beads. The portion of the paper layer covering and adjoining each shoulder is provided with a protective coating making it far more resistant to scuffing during the sanding operation in preparation for painting. The protective coating has a composition to which paint will readily adhere. As part of the invention this protective coating is also applied to the pater cover layer of tape-on corner beads.

DETAILED DESCRIPTION OF THE INVENTION

Figure 1:
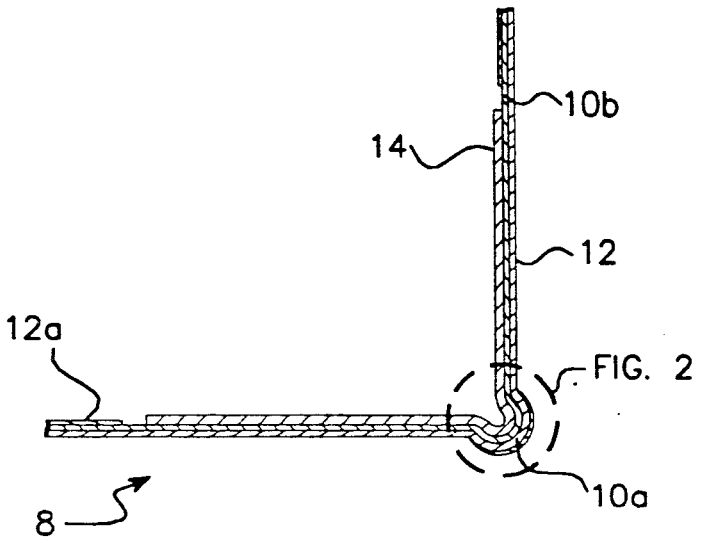
FIG. 1 is a transverse cross-sectional view of a hard-line corner bead made in accordance with the present invention, and with the thickness of the elements being exaggerated for illustrative purposes.

Referring to the drawings, it is seen that finished hard-line and soft-line nail-on corner beads 8, 9 made in accordance with the present invention have a respective core strip 10, 11 and a respective paper cover strip 12 or 13. The core strip is preferably a galvanized steel strip which has been roll-formed to the hard-line shape 10 having a corner rib **10*a* and side flanges 10*b*, or to the soft-line shape 11 having a rounded nose 11*a*, a pair of step-down sloped shoulders 11*b*, and side flanges 11*c*. A typical hard-line core strip 10 will have its side flanges 10*b* at ninety degrees to one another and about one inch wide, and a typical soft-line core strip 11 will have its rounded nose 11*a* shaped with a radius in the range of about ¾ to 1½ inches, and its side flanges 11*c* at a right angle relative to one another and about one inch wide. The corner rib 10*a* on the hard-line unit will typically be about 0.0625 inches high and about 0.125 inches wide. Each of the shoulders 11*b* on the soft-line unit will typically be about 0.125 inches wide and have a drop of about 0.0625 inches from the corresponding outer edge of the rounded nose section 11***a* and the adjoining side flange 11*c*.

The cover strips 12, 13 have their outer edge portions 12*a* and 13*a* folded back over the outer edges of the respective core strips 10, 11 a distance of about 0.25 inches. For economy of construction, respective reinforcing backing strips 14, 15 of paper may be applied to the core strips 10, 11 between the folded-back edge portions 12*a*, 13*a* of the respective cover strips 12, 13. The cover strips 12, 13 may be 80 to 90 pound bleached kraft paper like that commonly used for wallboard joint tape, and the backing strips 14, 15 may be kraft paper about 0.016 to 0.017 inches thick like that commonly used for backing paper on wallboard. When the backing strips 14, 15 are not used, the core strips 10, 11 will normally be about 0.012 to 0.013 inches thick, whereas the core strips need only be about 0.007 to 0.009 inches thick when the backing strips are included. Hot melt glue or other suitable adhesive (not shown) is used to bond the entire back surface of the cover strips 12, 13 and backing strips 14, 15 to the core strips 10, 11.

In accordance with the present invention a center band 16 of a protective coating is applied to the outer face of the cover strip 12, and a pair of bands 17 of a protective coating is applied to the portions of the outer face of the cover strip 13 which cover the pair of shoulders 11*b* and are adjacent thereto. The protective bands 16, 17 preferably extend about 0.125 inches beyond both side edges of the corner rib 10*b* and the shoulders 11*b*. Although for production economy it is preferred to have relatively narrow protective bands, it will be appreciated that in the case of the soft-line bead 9 a protective band may extend over the entire width of the nose 11*a* between the pair of shoulders 11*b*.

Figure 5:
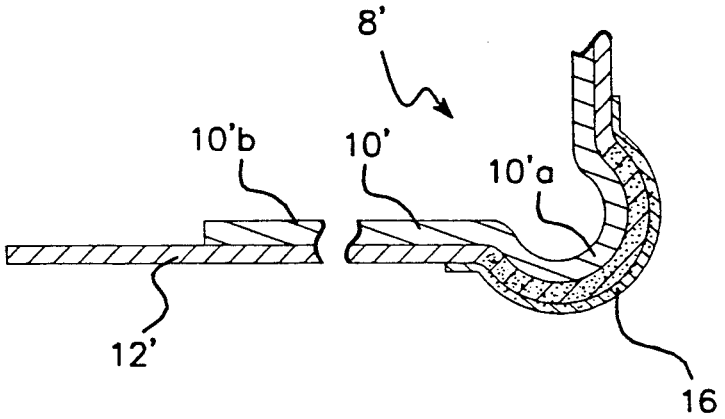
FIGS. 5 and 6 are fragmentary transverse cross-sectional views of a hard-line corner bead and soft-line corner bead, respectively, of the tape-on type provided with the protective coating in accordance with this invention.
Figure 6:
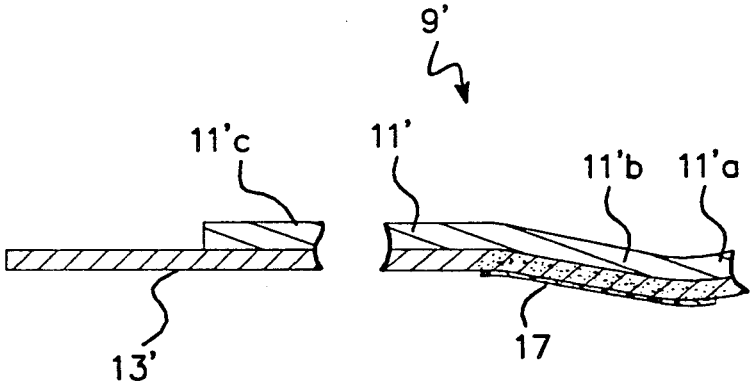

FIGS. 5 and 6 show the protective bands 16 and 17 applied to standard tape-on beads 8' and 9' with hard-line and soft-line configurations in which the paper cover layers are numbered 12' and 13', and the metal core strips are identified by 10' and 11', respectively. The portions of the core strips are identified in the same manner as in FIGS. 2 and 3, except that a prime has been added.

The bands 16, 17 of protective coating preferably result from treatment of the outer paper layers 12, 13 (12', 13') with a material which penetrates the fibers of the paper to reinforce the paper and provide surface protection against abrasion. For example, the coating material for the bands 14 15 may comprise a fine particle size, acrylic, water-based emulsion such, for example, as Synthemul® synthetic resin emulsion 40-423, produced by Reichhold Chemicals, Inc., Dover, Del., diluted 50% with water. This material may be applied by a brush, roller or spraying apparatus. When the coating has dried, the surface of the paper area to which the coating material has been applied will normally have an acrylic film or layer about 0.001 inches in thickness. This surface film or layer can be increased in thickness to about 0.005 inches by using a suitable primer sealer for the protective coating. For example, the same acrylic resin can be utilized with the following additional ingredients:

| INGREDIENT | % (BY WEIGHT) |
|---|---|
| Water | 8.00 |
| Ethylene Glycol | 1.00 |
| Cellulosic thickness solution | 16.00 |
| Potassium Tripolyphosphate | 0.10 |

-continued

| INGREDIENT | % (BY WEIGHT) |
|---|---|
| Defoamer | 0.40 |
| Surfactant | 0.40 |
| Aluminum Silicate | 12.00 |
| Titanium Dioxide | 7.50 |
| Calcium Carbonate | 15.00 |
| Microbial Agent | 0.10 |
| Acrylic Resin | 39.50 |

A typical cellulosic thickener is Natrosol 250 HR solution (1½%).

Figure 2:
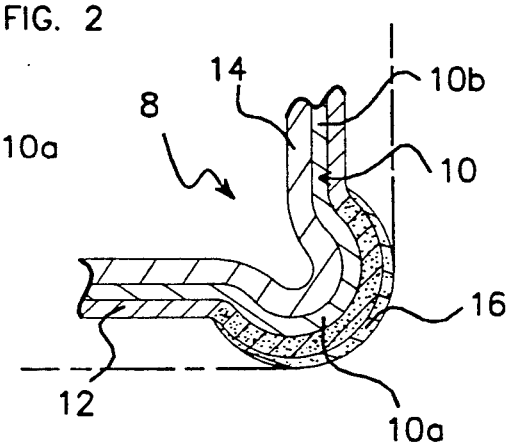
FIG. 2 is a detail sectional view to an enlarged scale of the circled portion indicated in FIG. 1.
Figure 3:
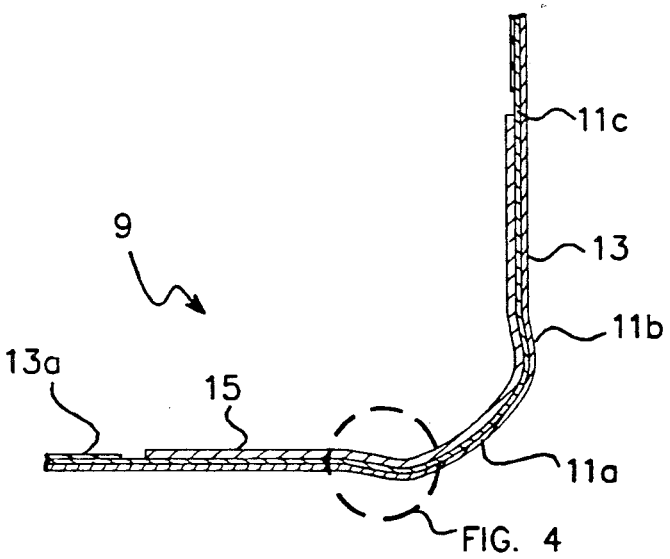
FIG. 3 is a transverse cross-sectional view of a soft-line corner bead made in accordance with the present invention, and with the thickness of the elements being exaggerated for illustrative purposes.
Figure 4:
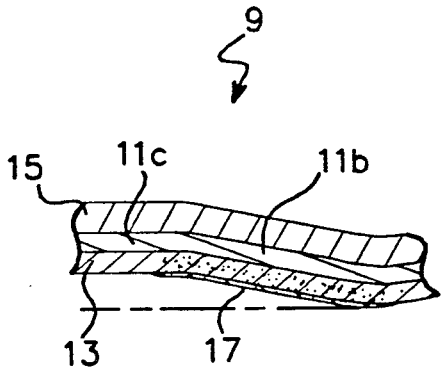
FIG. 4 is a detail sectional view to an enlarged scale of the circled portion indicated in FIG. 3.

In applying the hard-liner and soft-line embodiments of the nail-on beads 8–9, nails are driven at regular intervals through the outer cover strips 12, 13 underlying flanges 10*b*, 11*c* of the core strips, and backing strips 14, 15, and then spackle or joint cement is feathered from the outer face of the underlying wallboard to the rib 10*a* and shoulders 11*b* so as to cover the outer edges of the corner beads and the nails, as indicated in phantom in FIGS. 2 and 4. Since the outer edges of each core strip 10, 11 and the outer faces thereof are covered with paper there is good adherence of the spackle or joint cement to the corner beads. When the spackle or joint cement is later sanded the protective bands 16, 17 prevent adverse scuffing of the paper 12 covering the corner rib 10*a* and the paper 13 covering the rounded nose 11*a* adjacent the shoulders 11*b*. Covering of the relatively sharp outer edges of the metal core strips 10, 11 with the paper covering 12, 13 has the added advantage of protecting workers from hand cuts while handles the corner beads.

The hard-line and soft-line corner beads 8'–9' of the tape-on type are applied in the conventional manner for tape-on beads. When the joint cement covering the outer paper layer 12' from the corner rib 10'*a* to the outer edge of the paper 12' on the hard-line tape-on bead 8', and covering the outer paper layer 13' from the rounded nose 11'*a* to the outer edge of the paper 13' on the soft-line tape-on bead 9', is sanded to dress the joint cement to the rib 10'*a* and nose 11'*a*, the protective bands 16', 17' prevent adverse scuffing of the outer paper layers 12', 13'.

It will be appreciated that the thickness of the protective coatings 16, 17 have been somewhat exaggerated in the drawings for illustrative purposes. The portions of the outer paper layer in FIGS. 2, 4, 5 and 6 adjoining the protective coatings 16, 17 have been dotted to indicate impregnation of the paper by the coating material.

We claim:

1. A corner bed for drywall construction, comprising:

a core strip having a central portion, two side flanges extending laterally at about a right angle relative to one another, and respective shoulder portions joining said central portion and said side flanges;

a front paper layer covering the outer face of said core strip and bonded thereto; and a thin protected coating on said front paper layer at said should portions and an adjoining portion of said central portion along the length of said core strip, said protective coating penetrating some of the fibers of said front paper layer and having a thickness on the front surface of said front paper layer of about 0.001 to 0.005 inches, said shoulder portions, front paper layer, and protective coating collectively providing outer exposed shoulders so that joint cement or the like can be applied over the paper-covered flanges and dressed to said exposed shoulders after the corner bead is applied to a drywall corner, said protective coating being substantially more resistant to abrasive action than joint cement.

2. A corner bead according to claim 1 in which said front paper layer has doubled back portions behind said core strip and covering the outer edges of said side flanges.

3. A corner bead according to claim 1 in which said central portion comprises a rounded nose between said shoulders.

4. A corner bead according to claim 1 in which said central portion and shoulders comprise a rib at the longitudinal center line of said core strip.

5. A corner bead according to claim 2 in which a back paper reinforcing layer covers most of the back of said core strip between said doubled back portions of said front paper layer.

6. A corner bead according to claim 5 in which said core strip is galvanized steel having a thickness of about 0.007 to 0.009 inches.

7. A corner bead according to claim 1 in which said protective coating contains an acrylic resin.

* * * * *

UNITED STATES PATENT AND TRADEMARK OFFICE

CERTIFICATE OF CORRECTION

PATENT NO. : 5,131,198

DATED : July 21, 1992

INVENTOR(S) : James A. Ritchie; Don E. King

It is certified that error appears in the above-identified patent and that said Letters Patent is hereby corrected as shown below:

In column 4, claim 1, line 51, please delete "bed" and substitute therefor -- bead --.

In column 4, claim 1, line 66, please delete "outer" and substitute therefor -- outermost --.

In colum 5, claim 1, line 1, please insert -- outermost -- between "said" and "exposed".

Signed and Sealed this

Twenty-eighth Day of September, 1993

Bruce Lehman

*Attest:*

BRUCE LEHMAN

*Attesting Officer*

*Commissioner of Patents and Trademarks*